United States Patent [19]

Steiner et al.

[11] Patent Number: 4,628,802

[45] Date of Patent: Dec. 16, 1986

[54] WHOLE HOUSE FAN

[75] Inventors: Robert E. Steiner; Chandrakant V. Savla, both of St. Louis County, Mo.

[73] Assignee: Emerson Electric Co., St. Louis, Mo.

[21] Appl. No.: 830,899

[22] Filed: Feb. 18, 1986

Related U.S. Application Data

[60] Continuation of Ser. No. 618,892, Jun. 8, 1984, abandoned, which is a division of Ser. No. 428,090, Sep. 29, 1982, abandoned, which is a continuation of Ser. No. 248,021, Mar. 26, 1981, Pat. No. 4,385,550.

[51] Int. Cl.[4] ..... F24F 7/06

[52] U.S. Cl. ..... 98/42.1; 98/116

[58] Field of Search ..... 52/199; 98/40.05, 40.07, 98/42.07, 42.08, 42.09, 42.1, 116; 248/342, 343; 417/360, 361

[56] References Cited

U.S. PATENT DOCUMENTS

| | | | |
|---|---|---|---|
| 1,690,941 | 11/1928 | Nickerson | 98/43 |
| 1,693,396 | 11/1928 | Littleton . | |
| 2,278,581 | 4/1942 | Dexter | 98/43 |
| 2,673,514 | 3/1954 | Hanks | 98/116 |
| 2,875,678 | 3/1959 | Shepherd | 98/43 |
| 2,911,900 | 11/1959 | Rudy | 98/116 |
| 3,149,553 | 9/1964 | Solzman | 98/43 |
| 3,315,924 | 4/1967 | Greenwood | 248/27 |
| 3,895,568 | 7/1975 | Stone | 98/43 |
| 3,952,638 | 4/1976 | Felter et al. | 98/75 X |
| 4,123,968 | 11/1978 | Malott | 98/43 R |
| 4,261,255 | 4/1981 | Anderson et al. | 98/42 R |
| 4,271,751 | 6/1981 | Timmons | 98/40 D |

FOREIGN PATENT DOCUMENTS

| | | | |
|---|---|---|---|
| 648597 | 9/1964 | Belgium | 98/43 R |
| 819012 | 8/1959 | United Kingdom . | |

OTHER PUBLICATIONS

Chelsea Fans & Blowers—Ceiling Mounting.

Hunter ventilating fans—1978 and installation instructions.

Lau Incorporated, 22" Builder's Special, pp. 9 and 12.

*Primary Examiner*—Harold Joyce

*Attorney, Agent, or Firm*—Polster, Polster and Lucchesi

[57] ABSTRACT

A whole house ventilator which can be installed without framing and cutting joists. Struts below the fan blade serve as a support for a fan motor and for a venturi. Adjustable pre-cut sleeving fits over the joists and around the fan to eliminate framing. A shutter assembly may be surface-mounted to the ceiling below the joists.

20 Claims, 8 Drawing Figures

WHOLE HOUSE FAN

This is a continuation of copending application Ser. No. 618,892, filed on June 8, 1984, now abandoned, which is a division of application Ser. No. 428,090, filed on Sept. 29, 1982, now abandoned, which is a continuation of application Ser. No. 248,021, filed Mar. 26, 1981, now U.S. Pat. No. 4,385,550.

BACKGROUND OF THE INVENTION

This invention relates to a whole-house fan and in particular to a whole-house fan which is easier to install than those presently known.

A whole-house fan typically includes a fan assembly framed into the floor joists of an attic area and a shutter assembly secured to the fan assembly through an opening in the ceiling of the living-area below the fan assembly. The fan assembly includes a sheet metal venturi having a peripheral depending skirt and a central opening or throat. Brackets mounted on the venturi support a fan impeller in the venturi throat. The impeller is driven by an electric motor which is typically mounted either coaxially above the impeller for directly driving the impeller, or on a corner of the venturi for a belt drive. Whole-house fans are sometimes also mounted vertically on a gable or other wall.

Whole-house fans effectively prevent the build-up of heat in the building interior and attic, with a minimum of energy consumption. Their expanded use, however, has been hindered because the fan assemblies are difficult to install. To create the required opening between the living-area and the attic, a hole is cut in the living-area ceiling. The impeller diameter is typically on the order of 2 feet to 3 feet, the opening is typically from 2 feet to 4 feet square, and ceiling joists are typically 16 inches or 24 inches on center. Therefore, one or more joists must be cut. A frame is then built by nailing headers to the ends of the cut joists. In unfinished attics, a platform is laid over the joists to support the fan. The fan assembly is then mounted to the platform, and the shutter assembly is mounted to the ceiling.

SUMMARY OF THE INVENTION

One of the objects of this invention is to provide a whole-house fan which is easier to install in a ceiling than presently existing fans.

Another object is to provide such a fan which is simple and relatively inexpensive to manufacture.

Other objects will occur to those skilled in the art in light of the following description and accompanying drawings.

In accordance with one aspect of this invention, generally stated, a whole-house fan assembly is provided which includes a venturi for defining an air path, the venturi having an opening defining a throat, an impeller for drawing air through the venturi throat, and a motor for driving the impeller, characterised in that the venturi includes a depending skirt having means in it for accommodating joists to permit the skirt to fit over at least one joist and into close propinquity with the ceiling. Preferably, the skirt is made of corrugated sheet material, and includes a plurality of pre-scored tabs for accommodating differently spaced joists and joists of different heights.

In accordance with another aspect of the invention, a frame is provided which supports the impeller, the motor and the venturi, and which includes mounting means for mounting the frame to the upper faces of joists. Preferably, the frame includes a pair of spaced-apart U-brackets, the housing is attached to up-turned arms of the U-brackets and the impeller motor is attached by a mounting plate to horizontal reaches of the U-brackets.

In accordance with another aspect of the invention, a whole-house fan assembly is provided which includes a venturi for defining an air path, the venturi having an opening defining a throat, a fan for drawing air through the venturi throat, and a motor for driving the fan, characterized in that the motor is mounted coaxially with and below the fan.

Preferably, the venturi includes a sheet metal fan housing part and a separate skirt formed of one or more panels.

Other aspects of the invention will be better understood in light of the following description of the preferred embodiment.

DESCRIPTION OF THE PREFERRED EMBODIMENT

Figure 1:
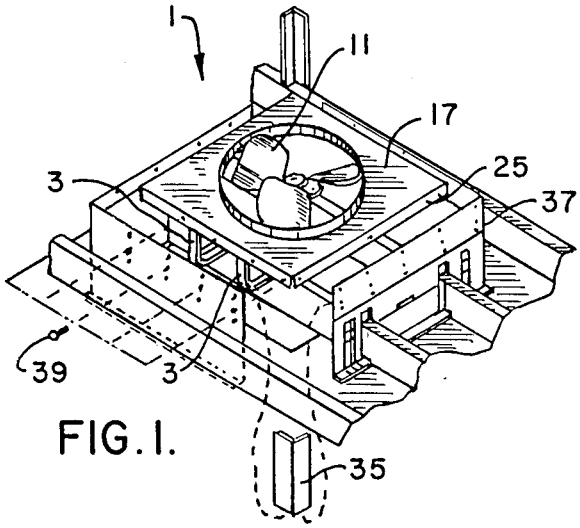
FIG. 1 is an exploded view in perspective of one illustrative embodiment of whole-house fan of the present invention mounted in an ceiling structure.

Referring now to the drawings, reference numeral 1 indicates a whole-house fan assembly of the present invention. The fan assembly 1 includes a pair of parallel U-shaped brackets 3, a fan mounting bracket 5 welded to the horizontal reaches of the U-shaped brackets 3, a fan motor 7 extending through a central opening 9 in the fan mounting bracket 5, a three-bladed fan impeller 11 mounted on the upwardly extending shaft 13 of the motor 7, and a venturi 15 including a sheet metal fan housing 17 and a peripheral depending skirt 19.

Each of the U-shaped brackets 3 includes a horizontal reach 21 having pre-drilled holes 20 spaced sixteen inches apart and twenty-four inches apart for mounting the fan assembly 1 on joists 22. In the illustrative embodiment, the joists 22 are two-by-six boards spaced on sixteen inch centers. The upper ends of vertical arms 23 of the U-shaped brackets 3 are welded to a down-turned peripheral flange 25 of the fan housing 17. The fan housing 17 further includes a conventional central throat 27 in which the fan impeller 11 is mounted.

Ears 29 are welded to the fan motor 7 for mounting the motor 7 to the bracket 5 by means of bolts 31 and rubber vibration-damping grommets 33.

Figure 7:
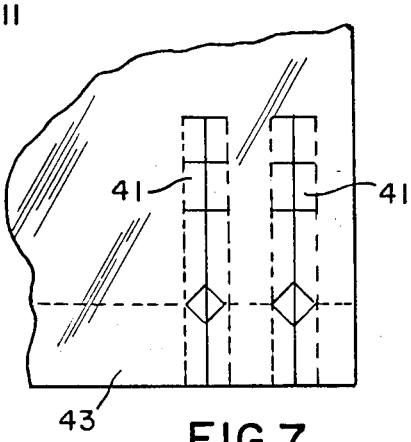
FIG. 7 is a detail of a skirt part of the fan of FIGS. 1 and 2.
Figure 3:
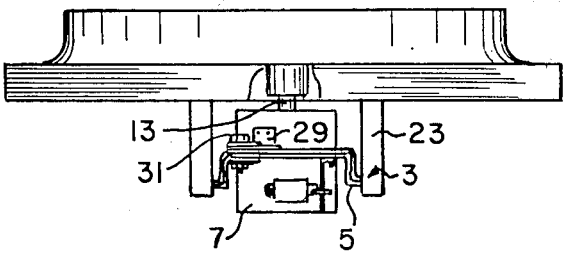
FIG. 3 is a view in side elevation of the fan of FIGS. 1 and 2.

The skirt 19 is formed of two identical sheets of corrugated board, preferably polypropylene. The two pieces forming the skirt 19 are held to each other by corner brackets 35 into which the free ends of the skirt 19 are pressed during installation of the fan assembly 1. All four walls of the skirt 19 include pre-scored holes 37 for securing the skirt 19 to the flange 25 of the fan housing 17. Three sets of holes, spaced two inches apart vertically, are provided on all four walls of the skirt 19, to accommodate joists 22 which are nominally four, six or eight inches tall. Two opposing walls of the skirt 19 further include pre-scored tabs 41 for accommodating joists on different spacings and of different heights. FIG. 7 shows details of the tabs 41, with pre-scored cutting lines shown as solid lines and pre-scored bending lines shown as dotted lines. It will be seen that the tabs 41 are bent out along the joists 22 and facilitate taping the openings around the joist if desired. Likewise, a flap 43 is bent out at the bottom of the skirt 19 to form a tight fit with the upper face of the ceiling 45.

Figure 4:
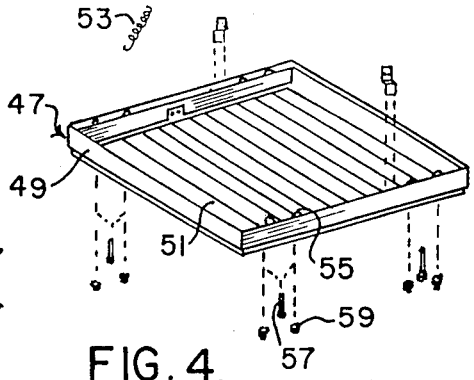
FIG. 4 is an exploded view in perspective of a shutter assembly for use with the fan of FIGS. 1–3.
Figure 5:
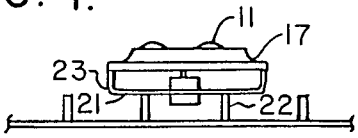
FIG. 5 is a somewhat diagrammatic view in end elevation of the fan of FIGS. 1–3, partially installed in a ceiling.
Figure 6:
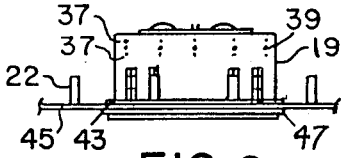
FIG. 6 is a somewhat diagrammatic view in end elevation of the fan and shutter assembly of FIGS. 1–4, corresponding to FIG. 5, showing the fan and shutter assembly installed in a ceiling.
Figure 2:
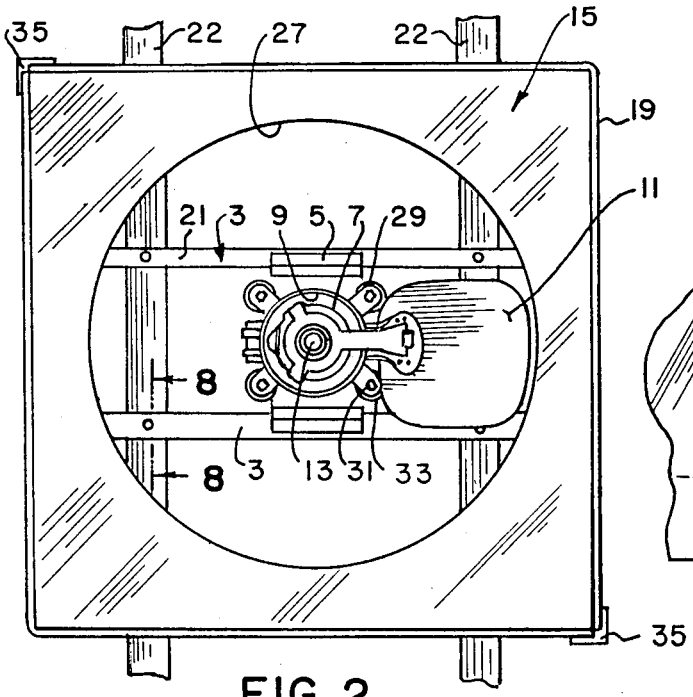
FIG. 2 is a top plan view, partially cut away, of the fan of FIG. 1.

Referring now to FIG. 4, the shutter assembly 47 includes a frame 49 carrying a plurality of shutters 51 which are conventionally connected to each other for simultaneous movement. A spring 53 biases the shutters closed. The frame 49 includes openings 55 for wood screws 57. The openings 55 are spaced sixteen inches and twenty-four inches apart, for surface mounting the shutter assembly 47 to the underside of ceiling 45 and securing it to the joists 22. Plugs 59 are provided for all eight openings 55, to provide a finished appearance for the frame 49.

Figure 8:
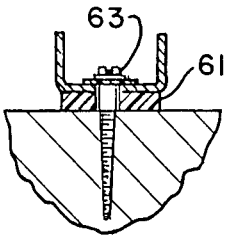
FIG. 8 is a partial sectional view taken along the line 8—8 of FIG. 2.

The assembly of the fan 1 and shutter assembly 47 to a ceiling, without cutting joists, is accomplished as follows. A suitable place is chosen in accordance with established criteria. If the place selected is a hallway, the joists must run perpendicular to the hallway. Any obstructions such as pipes or wires in the attic are removed. A hole is drilled from below in the center of the desired location, and a wire is passed through the hole to mark the spot. Using the wire as a transverse center line, the point half way between joists is found and a second hole is drilled from above. Using the second hole as the center, an opening is cut in the ceiling to fit the fan assembly 1. Rubber grommets 61 are forced into the appropriate holes 20 in the U-shaped brackets 3 for the spacing of joists 22. The fan assembly 1 is lifted through the ceiling hole and placed on the joists 22, centered on the ceiling opening. Electrical connections are made to the fan motor. The skirt 19 is assembled with clips 35, the appropriate tabs 41 are bent out for the spacing and height of the joists 22, and the skirt is attached to the housing 17 by fasteners 39. The assembly is then secured to the joists by screws 63 extending through the grommets 61, as shown in FIG. 8. It will be seen that when the fan assembly 1 is installed, the motor 7 extends below and between the joists 22. If desired, the joint between the skirt and the ceiling and joists may be taped or caulked to reduce air leakage.

The spring 53 on the shutter assembly 47 is stretched between brackets on the frame 49 and on the shutters 51 to an adjustment at which the spring 53 just closes the shutters 51. The shutter assembly is then secured to the joists 22 by screws 57. The shutters 51 are mounted in the frame 49 in such a manner as to clear the bottoms of the joists 22 when the shutters are open. The shutters are balanced to be pulled open by the draft of the fan, but to close when the fan is not running, as is conventional.

Numerous variations in the whole-house fan of the present invention, within the scope of the appended claims, will occur to those skilled in the art in light of the foregoing disclosure. Merely by way of example, the preferred fan assembly may be mounted vertically to an exterior wall, without cutting the wall studs, by mounting the fan assembly with the support brackets to the inside of the attic and using four mounting brackets extending from the studs to and around the flange 25 of the fan housing 17 to hold the fan housing the proper distance from the wall. The skirt 19 is then attached to the flange 25, between the fan housing and the wall, and the tabs 41 are bent around the studs. Exterior shutters are then attached to the exterior of the wall. Likewise, the fan assembly 1 may be mounted on a ceiling or wall by cutting joists or studs and building a frame in the conventional manner, to permit the shutters to be recessed flush into the ceiling or wall. Preferably, a pair of two-by-six supports are notched and mounted in the frame, so that the fan assembly is mounted to the supports and the bottom of the skirt is sealed to the top of the frame. These variations are merely illustrative.

What is claimed is:

1. A method of installing a whole-house fan in a ceiling without cutting joists in said ceiling, said fan comprising an assembly including a fan impeller rotatable about a vertical axis, a motor for driving said fan impeller, bracket means for supporting said motor, and a venturi, said ceiling being supported by a plurality of generally horizontal, parallel joists above said ceiling, said method comprising a step of cutting an opening in said ceiling to expose both sides of at least one said joist, a step of installing said assembly above said ceiling with said venturi positioned around and above said opening for defining an air path through said assembly, and a step of attaching said bracket means to said at least one exposed joist within said venturi, said step of installing said assembly including a step of extending said venturi on both sides of said at least one exposed joist into close propinquity to said ceiling, all of said steps being carried out without cutting said at least one exposed joist.

2. The method of claim 1 wherein said venturi is formed of a first part including a central opening defining a venturi throat, said first part being fixed with respect to said axis of said impeller, and a peripheral skirt, and wherein said step of installing said assembly comprises installing said skirt around the periphery of said first part of said venturi.

3. The method of claim 1 wherein said step of cutting an opening exposes both sides of two adjacent joists, and wherein said step of attaching said assembly includes attaching said assembly to upper faces of said two adjacent joists without cutting either of said joists.

4. The method of claim 1 including a further step of installing on the lower face of said ceiling a shutter assembly, said shutter assembly completely covering said opening, said shutter assembly comprising a shutter frame and a plurality of shutters mounted in said shutter frame, said shutters extending across said exposed joist and being spaced below said exposed joist sufficiently to clear the bottom of said exposed joist when said shutters are drawn open by the draft of said fan impeller.

5. The method of claim 2 wherein said skirt is formed of sheet material and wherein tabs are prescored in said sheet material on opposing sides of said skirt to accommodate said at least one joist, said step of installing said skirt comprising bending out said tabs to extend along said joist.

6. The method of claim 5 wherein said skirt includes a plurality of tabs on each of said opposing sides of said skirt, said step of installing said skirt comprising bending out said tabs to extend along a plurality of said joists.

7. The method of claim 1 wherein said venturi comprises a peripheral skirt formed of sheet material and wherein said step of installing said assembly comprises installing said skirt around at least two said joists to form said air passage.

8. The method of claim 1 wherein said venturi comprises a peripheral skirt and wherein said skirt is formed of two identical pieces, each extending around and above said at least one exposed joist, and wherein said step of installing said skirt comprises joining said two pieces.

9. The method of claim 7 wherein said skirt is formed of two identical pieces of corrugated board, each extending around and above at least one of said two joists, and wherein said step of installing said skirt comprises joining said two pieces of corrugated board.

10. The method of claim 1 wherein said venturi comprises a peripheral skirt formed of corrugated board material and wherein said step of installing said assembly comprises installing said skirt to extend around and above said at least one exposed joist.

11. The method of claim 10 wherein tabs are prescored in said sheet material on opposing sides of said skirt to accommodate said at least one joist, said step of installing said skirt comprising bending out said tabs to extend along said joist.

12. The method of claim 11 wherein said skirt includes a plurality of tabs on each of said opposing sides of said skirt, said step of installing said skirt comprising bending out said tabs to extend along a plurality of said joists.

13. The method of claim 12 wherein said tabs are scored to different heights, to accommodate joists of differing heights, said step of installing said skirt comprising bending out said tabs at the appropriate height for said joists.

14. The method of claim 1 wherein said venturi comprises a peripheral skirt, and wherein said step of installing said assembly comprises forming openings in said skirt to accommodate said at least one joist and installing said skirt to extend around and above said at least one exposed joist.

15. The method of claim 1 wherein said bracket means comprise a pair of spaced apart, elongate, generally horizontal frame members, said motor being supported by and between said frame members, and wherein said step of attaching said assembly to said at least one exposed joist comprises mounting said frame members to an upper surface of said at least one exposed joist.

16. The method of claim 15 wherein said venturi is formed of a first part including a central opening defining a venturi throat, said first part being mounted to said frame members, and a peripheral skirt, and wherein said step of installing said assembly comprises installing said skirt around the periphery of said first part of said venturi.

17. The method of claim 1 wherein said bracket means comprise openings extending therethrough, and said step of attaching said assembly to said at least one exposed joist includes positioning resilient pads below said openings in said bracket means and installing screws through said openings and said pads into upper faces of said joists.

18. The method of claim 1 wherein said step of attaching said assembly to said at least one exposed joist comprises mounting said motor coaxially with and below said fan impeller.

19. The method of claim 18 wherein said step of attaching said assembly to said at least one exposed joist causes said motor to extend below an upper surface of said at least one exposed joist.

20. A method of installing a whole-house fan assembly in a ceiling without cutting joists in said ceiling, and without building a support frame around the periphery of said fan assembly for supporting said fan assembly, said fan assembly comprising a fan impeller rotatable about a vertical axis and a motor for driving said fan impeller, said ceiling being supported by a plurality of generally horizontal, parallel joists above said ceiling, said method comprising a step of cutting an opening in said ceiling to expose at least one of said joists, and a step of installing said assembly above said at least one exposed joist, said step of installing said assembly including a step of forming a skirt of sheet material around the periphery of said assembly and above said opening to define a vertical air path through said assembly, said skirt extending on both sides of said exposed joist into close propinquity to said ceiling without supporting said fan assembly, all of said steps being carried out without cutting said exposed joist and without building a support frame around the periphery of said fan assembly for supporting said fan assembly.

* * * * *